US010246877B1

(12) United States Patent
Alpiger et al.

(10) Patent No.: US 10,246,877 B1
(45) Date of Patent: Apr. 2, 2019

(54) ARRANGEMENT FOR VENTILATING A LABORATORY ROOM

(71) Applicant: Wobatech AG, Wollerau (CH)

(72) Inventors: Thomas Alpiger, Pfäffikon (CH); Martin Gallmann, Kappel (CH)

(73) Assignee: WOBATECH AG, Wollerau (DE)

( * ) Notice: Subject to any disclaimer, the term of this patent is extended or adjusted under 35 U.S.C. 154(b) by 0 days.

(21) Appl. No.: 15/961,823

(22) Filed: Apr. 24, 2018

(51) Int. Cl.
*E04B 9/02* (2006.01)
*E04B 9/00* (2006.01)
*B01L 9/02* (2006.01)

(52) U.S. Cl.
CPC ..... *E04B 9/02* (2013.01); *B01L 9/02* (2013.01); *E04B 9/006* (2013.01)

(58) Field of Classification Search
CPC ..... E04B 9/02; E04B 9/006; E04B 9/064; H02G 3/0456; B01L 9/02; F24F 13/072; F24F 2221/14; F24F 7/06; F24F 13/078; F16L 3/26
See application file for complete search history.

(56) References Cited

U.S. PATENT DOCUMENTS 4,863,223 A * 9/1989 Weissenbach ..... H02B 1/04 312/209
5,156,395 A * 10/1992 Smith ..... A63B 63/083 248/188.4
5,263,290 A * 11/1993 Gardner ..... A62C 35/00 165/53
5,295,904 A * 3/1994 Aoki ..... F24F 13/32 454/233
5,358,444 A * 10/1994 Helm ..... F24F 7/08 454/306
5,687,527 A * 11/1997 Bikard ..... E04B 9/02 403/230
5,730,400 A * 3/1998 Rinderer ..... F16L 3/22 248/49

(Continued)

FOREIGN PATENT DOCUMENTS

EP 0834706 A1 4/1998
WO 2007033821 A1 3/2007
WO 2009153674 A1 12/2009

OTHER PUBLICATIONS

International Search Report dated Jun. 8, 2017.

*Primary Examiner* — Brian E Glessner
*Assistant Examiner* — Daniel J Kenny
(74) *Attorney, Agent, or Firm* — Tod M. Melgar; Melgar IP Law, pllc

(57) ABSTRACT

An arrangement for ventilating a laboratory is provided wherein a plurality of center carrier elements are in a spaced arrangement above a laboratory table row that defines two walking areas, one on each side of the table row. Each center carrier element comprises a vertical column element fastened on an upper end to the laboratory ceiling and at its lower end having center extension arms extending above the of laboratory table row. On the bottom side, the carrier elements carry a first and second air supply conduit in spaced relationship and delimit a lower receiving space therebetween extending over the length of the laboratory table row to carry supply lines. On the top side, the carrier elements carry an exhaust air conduit or alternatively, a side exhaust air conduit is received on side carrier elements opposite the first or the second air supply conduit.

17 Claims, 6 Drawing Sheets

(56) References Cited

U.S. PATENT DOCUMENTS

| | | | | |
|---|---|---|---|---|
| 5,918,432 | A * | 7/1999 | Mahone | A47B 47/00 52/220.2 |
| 6,198,047 | B1 * | 3/2001 | Barr | H02G 3/0456 174/101 |
| 7,634,967 | B1 * | 12/2009 | Albright | H02G 3/386 108/50.02 |
| 7,836,662 | B2 * | 11/2010 | Ludi | E04B 9/006 52/126.2 |
| 9,166,390 | B2 * | 10/2015 | Dean | H02G 3/0456 |
| 2015/0290646 | A1 * | 10/2015 | Rosenstein | B01L 9/02 312/209 |

* cited by examiner

ARRANGEMENT FOR VENTILATING A LABORATORY ROOM

FIELD

The present innovation relates to a modular system for ventilating a laboratory room.

BACKGROUND

Known laboratory ventilating systems such as disclosed in WO2007033821A1 generally comprise an intrinsically stiff carrier frame mounted on the ceiling of the laboratory to which the air supply conduits and exhaust air conduits are then attached above the walking area of the laboratory. Although these known ventilation arrangements have a high degree of flexibility with respect to expandability and changes in the spatial conditions of the laboratory, they are comparatively expensive and complex to install and mount due to their large size, and intrinsically stiff carrier frame. Moreover, they lower ceiling or overhead height in the walking area.

SUMMARY

The present disclosures and innovations solve the problems and deficiencies of known systems by providing an alternative arrangement for ventilating a laboratory that can be economically manufactured and readily installed over the laboratory table area rather than the walking area.

An arrangement is provided for ventilating a laboratory comprising a plurality of center carrier elements arranged in intervals from a ceiling above a laboratory table row. The carrier elements provide for carrying at least one air supply conduit that supplies fresh air into the laboratory, and may also provide for carrying exhaust air conduits, supply lines, lighting and other laboratory necessities.

Each center carrier element comprises a vertical column element extending from an upper end to a lower end. The upper end is adapted to be fastened to the ceiling. The lower end connected to at least a first and/or second extension arms extending horizontally from the vertical column element and over the laboratory table row.

The center carrier elements are adapted to carry a first and/or second air supply conduits having air exits. The first and the second air supply conduits are preferably attached to the bottom of the first and second extension arms, respectively, and spaced horizontally from one another to delimit a lower receiving space there between. The lower receiving space extends parallel to the air supply conduits substantially over the length of the laboratory table row. The lower receiving space is adapted to provide space for supply lines and other laboratory necessities, including, laboratory media such as technical gases and liquids.

An exhaust air conduit to remove air from the laboratory may be arranged on top of the first and/or the second extension arm or, in alternate embodiments, on side carrier elements adjacent the walking area opposite the first or second air supply conduit.

To increase rigidity of the structure, the first and/or the second air supply conduits may be fabricated from an intrinsically stiff material, such as metal sheeting, and be mechanically connected to two or more of the extension arms to form a torsion-resistant unit. Similarly, the exhaust air conduit may be mechanically connected by a screw connection to at least two extension arms of the carrier elements.

In further embodiments, a reinforcement element may be provided to secure the vertical column elements and the first and/or second extension arms, which may be fastened by sliding blocks and/or screws through the reinforcement member and into the outer sides of the vertical column elements and the first and/or second extension arms.

In yet further embodiments, the bottoms of the center carrier elements are connected to a longitudinal carrier extending above the laboratory table row and parallel to the longitudinal direction of the first and/or of the second walking area. The longitudinal carrier may include at least one longitudinal groove extending over the length of the carrier. The groove may serve to provide a means for mounting wall elements that divide the laboratory table row and/or provide for the spatial separation of regions of the first and of the second walking area. Additionally, shelves and/or media columns may extend from the longitudinal carrier for making available laboratory media such as technical gases, vacuum, water or electricity. The wall elements, shelves and media columns can be fastened to the longitudinal carrier in a detachable manner and can be freely positioned along the longitudinal carrier.

In further embodiments, the upper ends of the vertical column elements are coupled by a mechanical compensation arrangement to the ceiling of the laboratory. The mechanical compensation arrangement preferably comprises two plates that can be adjusted in their interval or spaced relationship and in their inclination to one another. One plate may be fastened to the ceiling and the other plate may be fastened to the first upper end of the vertical column element.

In yet further embodiments, an upper receiving space is arranged above the lower receiving space for the supply lines and is delimited laterally by the exhaust air conduit. Process exhaust air lines can be run in the upper receiver space.

In some embodiments, one or more adjustable traction elements are also included. Each traction element may connect the end of an extension arm to the laboratory ceiling, such as by an anchoring cable, whereby the extension arm can be loaded with a preferably adjustable traction force in the direction of the laboratory ceiling.

In alternate embodiments, exhaust air conduits may be placed in a side ventilation arrangement rather than, or in addition to, on the center carrier elements. In this arrangement, at least one side exhaust air conduit is carried by a plurality of side carrier elements having a horizontally extending side extension arm fastened on one end to a vertical column element. The at least one lateral or side exhaust air conduit may be received on the bottom of the side extension arms. Additionally, sanitary lines and/or process exhaust air lines or electrical lines may be arranged on the top of the side extension arms. These lines may be run in a plane above the at least one lateral or side exhaust air conduit. In this arrangement, the first air supply conduit and a first lateral or side exhaust air conduit associated with the side ventilation arrangement, as well as, the second air supply conduit and a second lateral exhaust air conduit associated with the other side ventilation arrangement are organized pairwise at an interval from one another on opposing sides of the first and of the second walking areas.

The foregoing arrangements according to the disclosure have the advantage that they can be locally installed in a laboratory with limited space and even as a retrofitting over an existing table row, due to its modular structure comprising individual small components compared to known carrier frames. Consequently, the relatively small sized carrier elements having two extension arms attached in a flying "T"

shaped manner can be readily assembled in the laboratory floor area and fastened to the ceiling on one end. After the carrier elements have been fastened to the ceiling, the air supply conduits can be fastened from below to the extension arms and according to a first embodiment the exhaust air conduit can be placed from above onto the arms and optionally screwed on. If desired, in this embodiment, process exhaust air lines can also be placed into the upper receiving space provided at the side of the exhaust air conduit, wherein good access is always ensured from the side during the entire assembly. Finally, supply lines for sanitary media can be included in the lower receiving space between the two air supply conduits. The supply lines are preferably placed on the corresponding holding arms that are preferably mounted by the suspension of the holding arms in corresponding longitudinal grooves on side walls of the air supply conduits. On the whole, this results in a very rapid and economical mounting of the ventilation arrangement according to the disclosure.

While the benefits and advantages of the ventilation system disclosed herein are generally described in the context of a laboratory, the disclosed concepts have a broad range of uses, including in manufacturing, hospitals or other settings with similar ventilation needs.

BRIEF DESCRIPTION OF THE DRAWINGS

The accompanying drawings illustrate various non-limiting, examples and innovative aspects of the ventilation system in accordance with the present descriptions.

DETAILED DESCRIPTION

Figure 1:
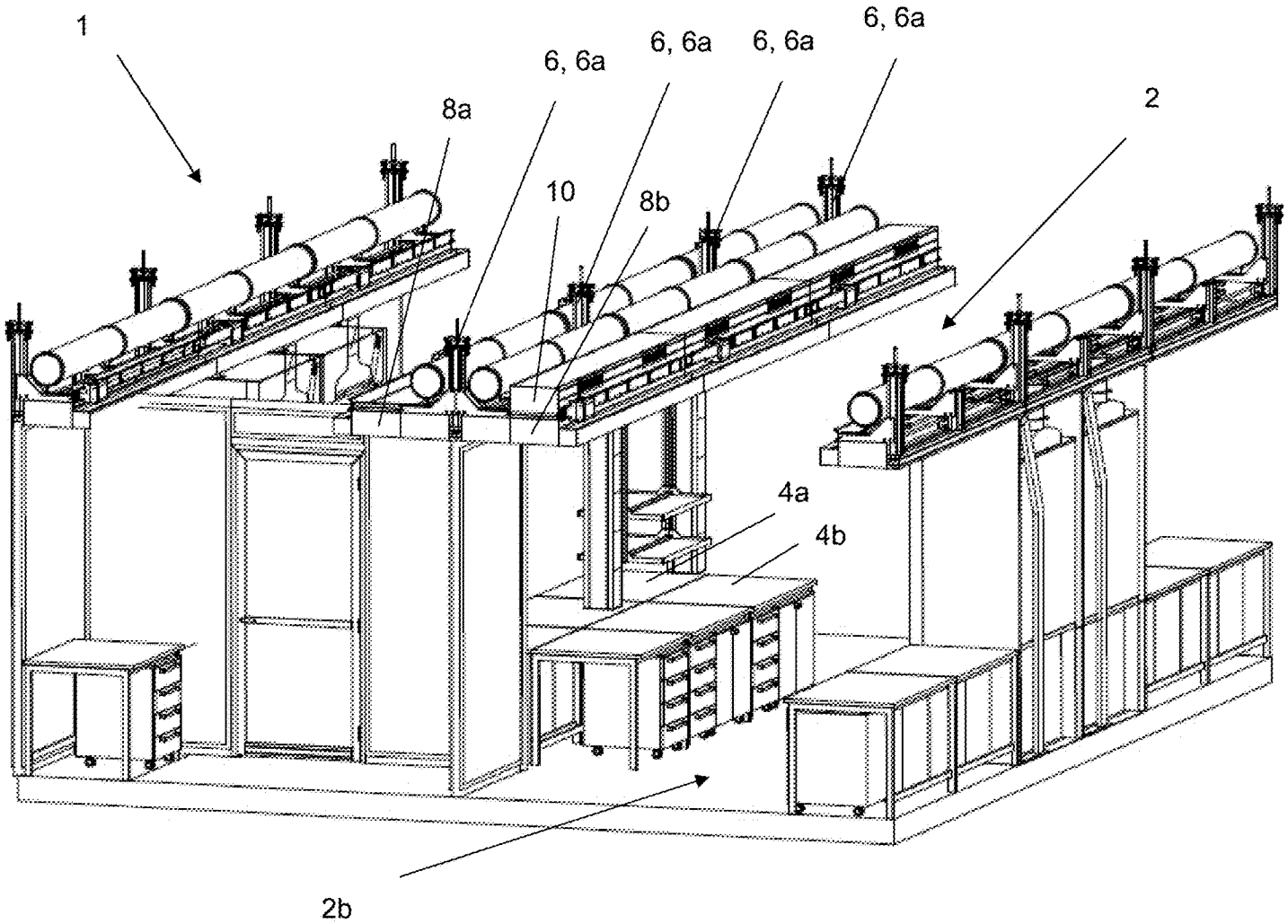
FIG. 1 shows a schematic spatial view of a laboratory with a first walking area partially closed on the first left side by wall elements and door elements and with an open, second walking area that is ventilated by the disclosed ventilation arrangement.

As is shown in FIGS. 1 to 4, a laboratory 2 has a first walking area 2*a* and a second walking area 2*b* that are separated from one another by a laboratory table row. The table row 4 may be composed of a single unit, multiple units or a first and a second row 4*a*, 4*b* of laboratory tables 4 arranged end to end. The arrangement 1 according to the disclosure comprises several carrier elements 6 arranged above the laboratory table row 4 and on which a first and a second air supply conduit 8*a*, 8*b* for supplying fresh air and at least one exhaust air conduit 10 for removing exhaust air from the laboratory 2 may be received.

In one embodiment, each of the carrier elements 6 may be composed of a vertical column element 6*a* adapted to be fastened at its upper end to the ceiling 12 of the laboratory 2 and fastened to an extension 14 at or near a lower end. The extension may comprise a first extension arm 14*a* extending toward one side of the laboratory table row 4*a* and a second extension arm 14*b* extending toward the other side of the laboratory table row 4*b*. The vertical column elements 6*a* are preferably arranged centrally over an imaginary vertical central plane which runs down the center of the table row or between the opposing back sides of the tables 4 of the first and second row 4*a*, 4*b*. The first and second extension arms 14*a*, 14*b* extend laterally or horizontally from the imaginary vertical central plane preferably completely in the area of the upper side of the tables 4; i.e., preferably only up to the edge of the table row or edge of the first or second walking area 2*a*, 2*b*.

As shown in FIG. 1, the vertical column elements 6*a* may be fastened in intervals of (e.g., 3 m) from each other in a vertical plane on the laboratory ceiling 12, which plane extends preferably to a center line of the laboratory tables 4. The first air supply conduit 8*a* has air outlets or exits. The outlets are preferably slot-shaped (not shown in detail) and are arranged on the bottom wall and/or lateral side wall to direct the air toward the walking area. The first air supply conduit 8*a* may be fastened to the under or bottom sides of the first extension arms 14*a*. A second air supply conduit 8*b*, preferably a mirror image to the first air supply conduit 8*a*, is received on the lower side of the second extension arms 14*b* and accordingly extends above the right side or second row 4*b* of the laboratory table row 4.

Figure 2:
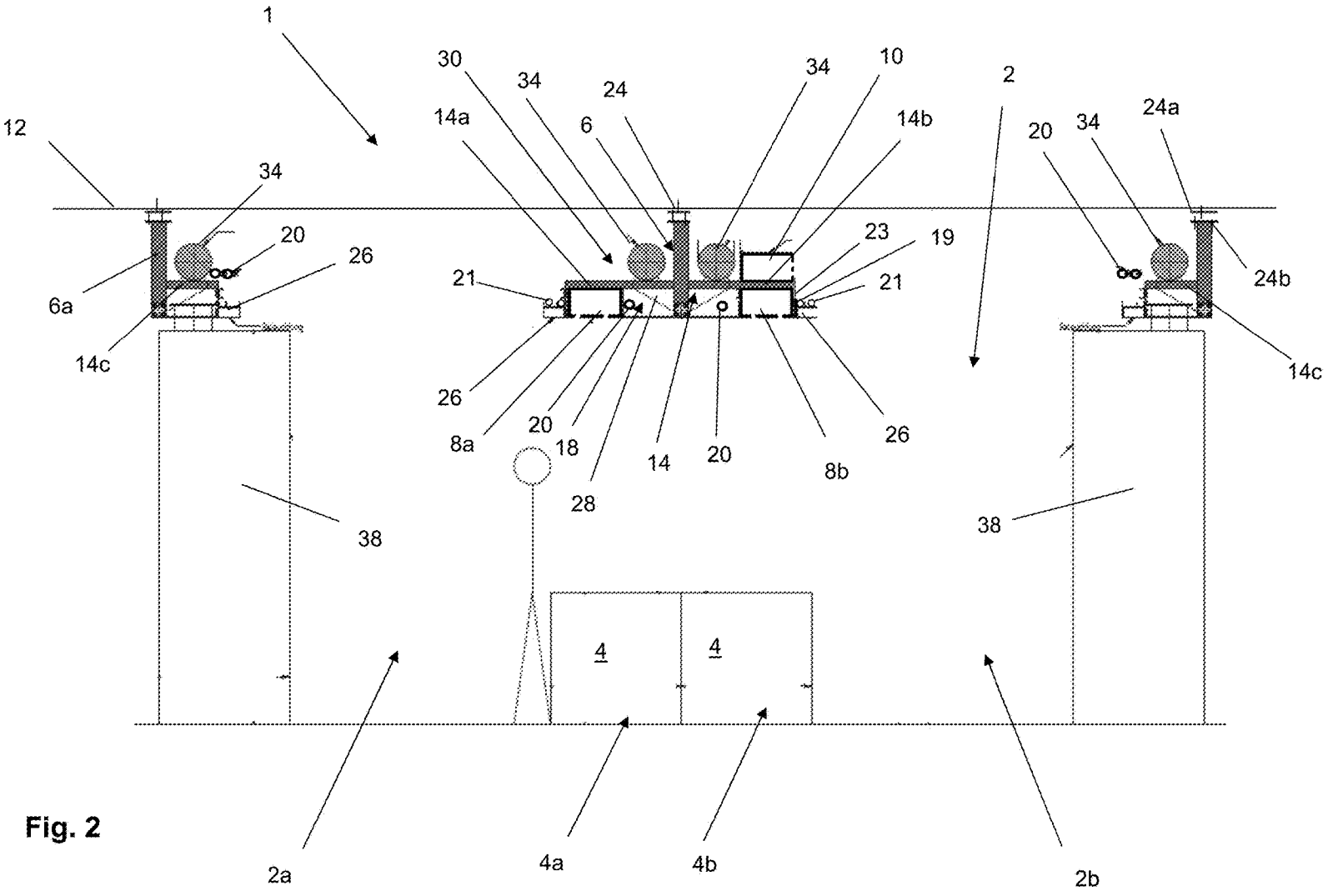
FIG. 2 shows a schematic cross-sectional view of a laboratory with a ventilation arrangement along a plane transverse to the walking areas.
Figure 4:
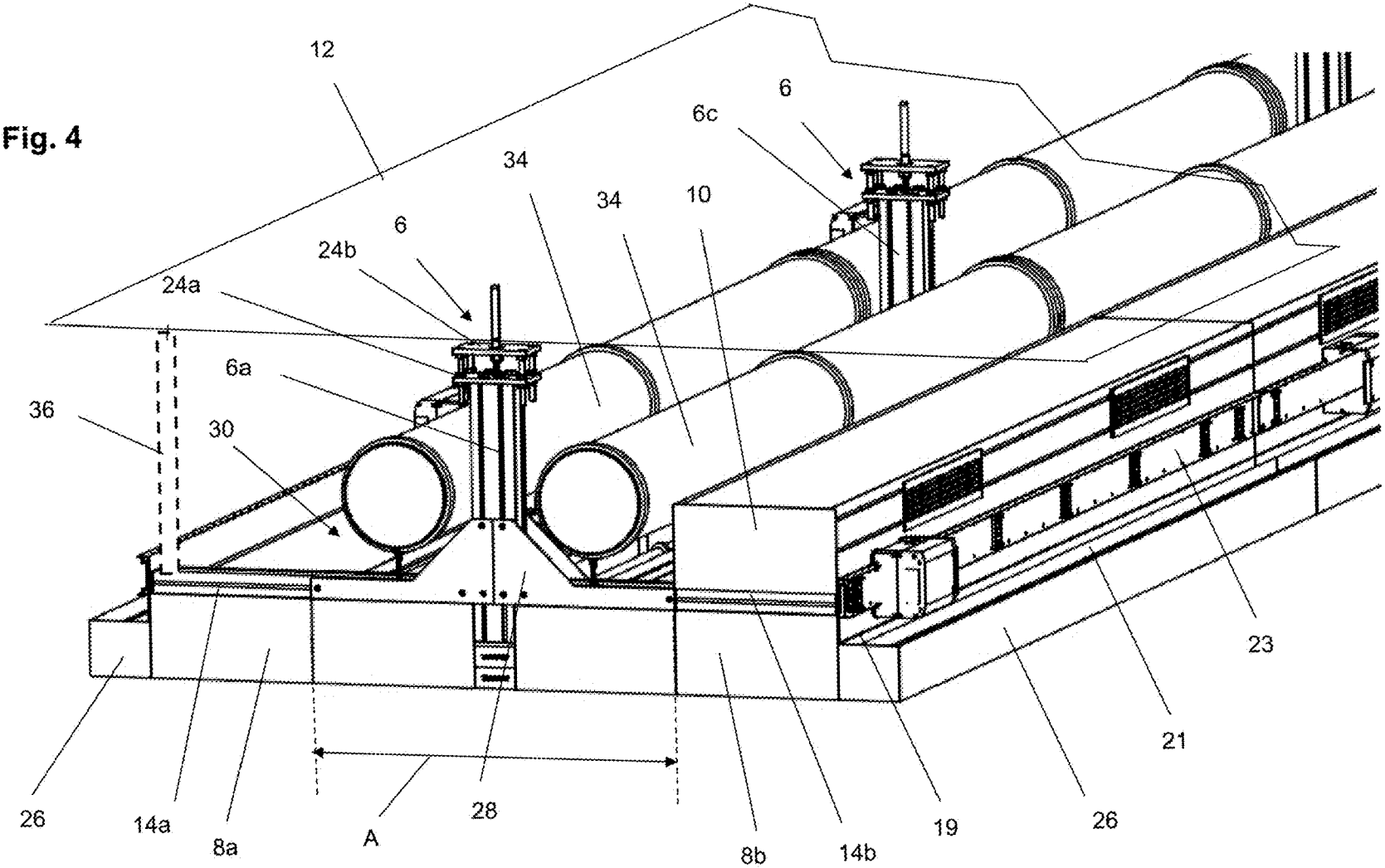
FIG. 4 shows an enlarged, sectional view of the ventilation arrangement of FIG. 1.

As shown in FIGS. 2 and 4, the first and the second air supply conduits 8*a*, 8*b* may be attached to the first and second extension arms in an unobstructed horizontal interval A (e.g., 0.9 m) from one another and delimit, with their outside walls, a lower receiving space 18 there between. The lower receiving space 18 extends parallel to the air supply conduits 8*a*, 8*b* over the length of the laboratory table row 4. The lower receiving space 18 is preferably configured and adapted to receive supply lines 20, which serve to, for example, supply laboratory media such as technical gases and liquids, as well as, compressed air and vacuum. The lower receiving space 18 can have, for example, a width of a total of 800 to 1500 mm or even more.

Illuminating elements 26 may be provided for illuminating laboratory table row 4 and/or the walking areas 2*a*, 2*b*. The illuminating elements can be received underneath the first and/or the second extension arm 14*a*, 14*b*, preferably directly adjacent to the outer sides of the first and/or of the second air supply conduit 8*a*, 8*b*. To this end the illuminating elements can be secured in grooves preferably formed in profiles forming the outside side walls of the first and of the second air supply conduits 8*a*, 8*b*. Alternatively, the illumination elements 26 may be integrated in the air supply conduits 8*a*, 8*b*, or may be received in ceiling plates covering the lower receiving space 18 for the supply lines 20. Referring further to FIGS. 2 and 4, guides for EDV cable 19 and current cable 21, as well as, a current rail 23 may also be provided above the illumination elements 26.

In addition to the above, an exhaust air conduit 10 for the removal of air from the laboratory 2 (e.g., waste air generated in the area of the laboratory tables 4) may be provided and disposed as shown in FIG. 1 on the upper side of the first and/or second extension arms 14*a*, 14*b*. As shown in FIG. 4, the exhaust air conduit 10 is preferably rectangular in cross section, formed from metal sheeting, and has a plurality of spaced lateral suction removal openings distributed over its length.

The first and/or the second air supply conduit 8*a*, 8*b* may consist of an intrinsically stiff material, preferably of metal sheeting, and be mechanically connected to two or more of the extension arms 14*a*, 14*b*, forming a torsion-resistant unit. The connection is preferably a mechanical screw connection to at least two of the extension arms 14*a*, 14*b*, which make it possible to remove the air supply conduits 8*a*, 8*b* or also only partial segments of them as required.

Figure 3:
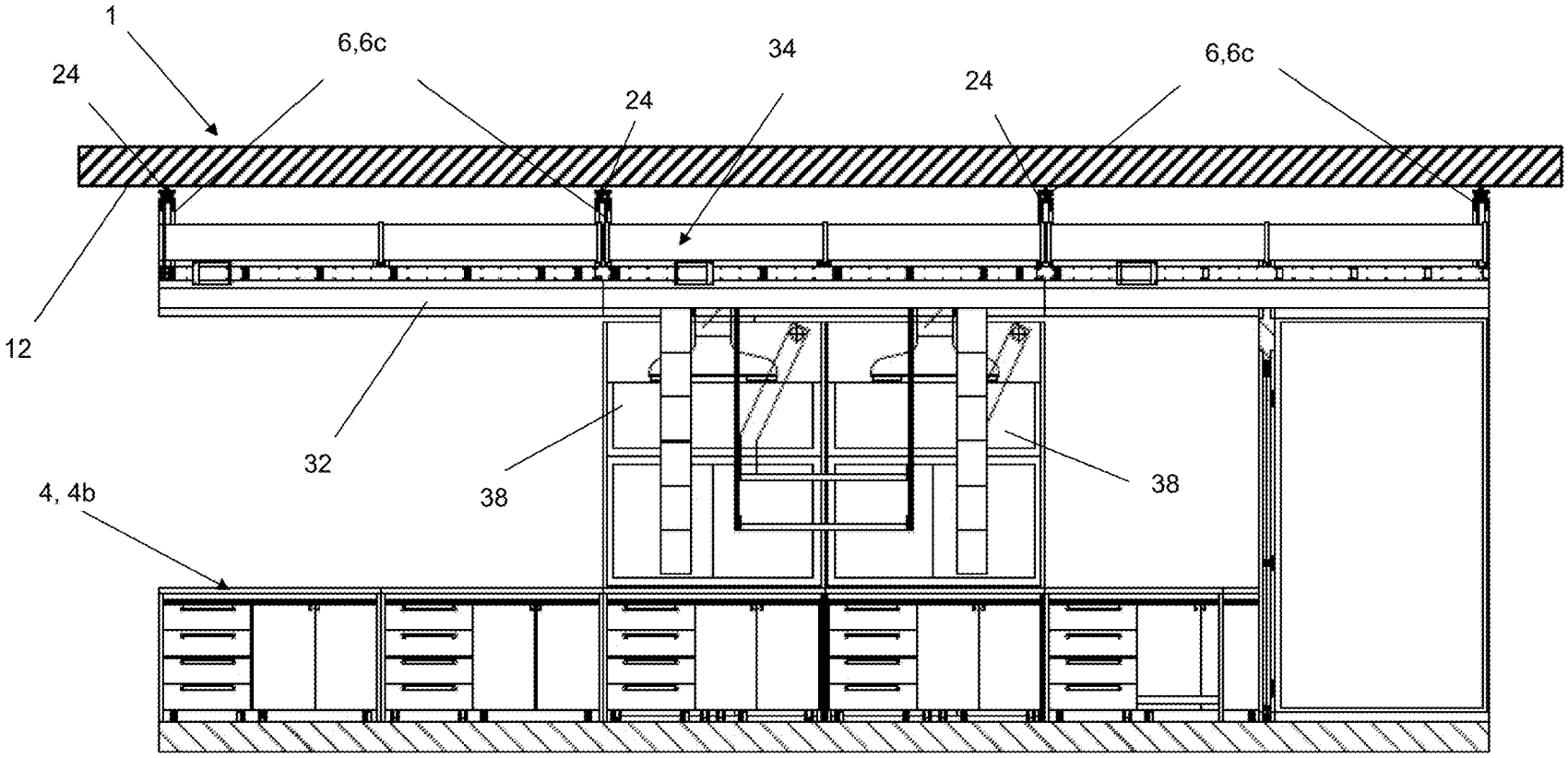
FIG. 3 shows a schematic cross-sectional view of the laboratory of FIG. 1 along a sectional plane running parallel to the walking areas.

As shown in FIGS. 3 and 4, the bottoms of the carrier element 6 may be connected to a longitudinal carrier 32 which extends above the laboratory table row 4 parallel to the longitudinal direction of the first and/or of the second walking area 2*a*, 2*b*. This has the advantage that the construction becomes considerably stiffer on the whole. In addition, wall elements can also be readily installed on the longitudinal carrier for spatially dividing the laboratory table row and separating the region of the first and the second walking areas 2*a*, 2*b* from one another. Additionally, shelves (not shown in detail) and/or media columns described in the previously cited international patent application (WO2007033821A1) can be fastened to the longitudinal carrier with few manipulations for making laboratory media available, such as, technical gases, a vacuum, water or electricity. To this end at least one longitudinal groove can be preferably formed in the area of the bottom of the longitudinal carrier 32, which groove may extend over the length of the longitudinal carrier. Wall elements and/or shelves and/or media columns can then be freely positioned by associated sliding blocks recessed or secured in the groove with screwing elements in a detachable manner along the carrier 32.

In conjunction with the previously mentioned wall elements, which can be suspended in the area of the imaginary vertical central plane along the table row, the table row can be separated into two discrete table rows 4*a*, 4*b* and associated walking areas 2*a*, 2*b*. This embodiment should also relate expressly to the claims of this application in as far as they concern a laboratory 2 with a building ceiling spanning the two walking areas 2*a*, 2*b*, on which ceiling the wall elements are fastened with the aid of the carrier elements 6 and the carrier 32.

Referring to FIG. 4, the upper ends of the vertical column elements 6*a* may be attached to a laboratory ceiling 12 by a mechanical compensation arrangement 24. The compensation arrangement may comprise two plates 24*a*, 24*b* (an upper plate and lower plate) having a spaced and inclination relationship with respect to one another wherein the spaced and inclination relationship is adjustable by screw elements, as indicated in FIG. 4. Of these plates, the upper plate 24*b* is adapted to be fastened to the ceiling 12 and the lower plate 24*a* may be attached to the upper end of a vertical column element 6*a*. The inclination of each column element 6*a* as well as its interval from the ceiling 12 can be adjusted during the mounting of arrangement 1 by rotating the screw elements, which as shown by example include four adjustment screws.

Furthermore, as shown in FIG. 4, the vertical column elements 6*a* and the first and/or second extension arms 14*a*, 14*b* can be coupled to each other by reinforcement elements 28. The reinforcement elements 28 may be fastened in particular by sliding blocks and/or screwing elements screwed into the latter to the outer sides of the vertical column elements 6*a* and the first and/or second extension arms 14*a*, 14*b*. The reinforcement elements 28, which preferably consist of steel plates or also aluminum plates, effectively increase the carrying ability of the extension arms 14*a*, 14*b* and additionally ensure that the torques generated by the air supply conduits and exhaust air conduits 8*a*, 8*b* and 10 are reliably transmitted to the vertical supports 6*a* even in the case of fire.

In addition to the reinforcement elements, or alternatively, the vertical column elements 6*a* and extensions 14*a*, 14*b*, may preferably be composed of aluminum profiles, mounted reliably into the ceiling 12 of the laboratory. Additionally, traction elements may be provided to strengthen the weight carrying ability of the system. For example, the traction elements may comprise steel rods (not shown) arranged on the inner sides of the aluminum profiles of the vertical column elements 6*a* which extend, e.g., from the lower, second carrier element-side receiving plate 24*b*, to the reinforcement elements 28.

At the same time or alternatively, one or several extension arms 14*a*, 14*b* can be coupled at their ends to a traction element 36, preferably an anchoring cable or threaded rod fastened to the building ceiling 12 and shown by way of example in FIG. 4. In this way, the extension arm 14*a*, 14*b* can be loaded with a preferably adjustable traction force in the direction of the ceiling 12 of the laboratory 4. Lateral pivoting of the arrangement can be reduced to a minimum at low cost using two such traction elements 36 on the first and the second extension arms 14*a*, 14*b* directly opposite one another. The holding forces from the traction elements 36 and reinforcement elements 28, and the intrinsically stiff connection between the two air supply conduits 8*a*, 8*b* and the extension arms strengthen the entire arrangement. This arrangement reduces the number of traction elements 36 in the extreme case to a minimum number of only 2 traction elements 36 positioned opposite one another, which correspondingly reduces the cost and maximizes the free space on the top of the extension arms 14*a*, 14*b* for the running of the lines.

Referring to FIG. 4, in another embodiment an upper receiving space 30 is provided above the receiving space 18 for the supply lines 20 which is delimited laterally by the exhaust air conduit 10. This upper receiving space can carry process exhaust air lines 34. The process exhaust air lines 34 serve to carry the gases that are removed by suction in the outlets 38 arranged on both sides of the first and the second walking areas. To this end side carrier elements 6 can be arranged above the outlets 38. These side carrier elements preferably only have one side extension arm 14*c* mounted in a flying manner and extending in the direction of the bordering walking areas 2*a*, 2*b*. These side extension arms 14*c* can similarly be fixed to the ceiling 12 of the laboratory 2 by traction elements 36 or holding elements (not shown in detail) in order to receive, if necessary, the torques produced by the process exhaust air lines 34.

The vertical column and arm elements 6*a*, 14*a*, 14*b* and 14*c*, as well as, the longitudinal carrier 32 are preferably known profile carriers whose outer circumferential surfaces contain at least one, but preferably two, grooves running parallel to one another. This creates the possibility of connecting the extension arms 14*a*, 14*b* to the extension arms 14*c* via the outlets 38 as needed by a transverse carrier (not shown in detail), in which other wall elements or devices can be suspended if desired.

Figure 5:
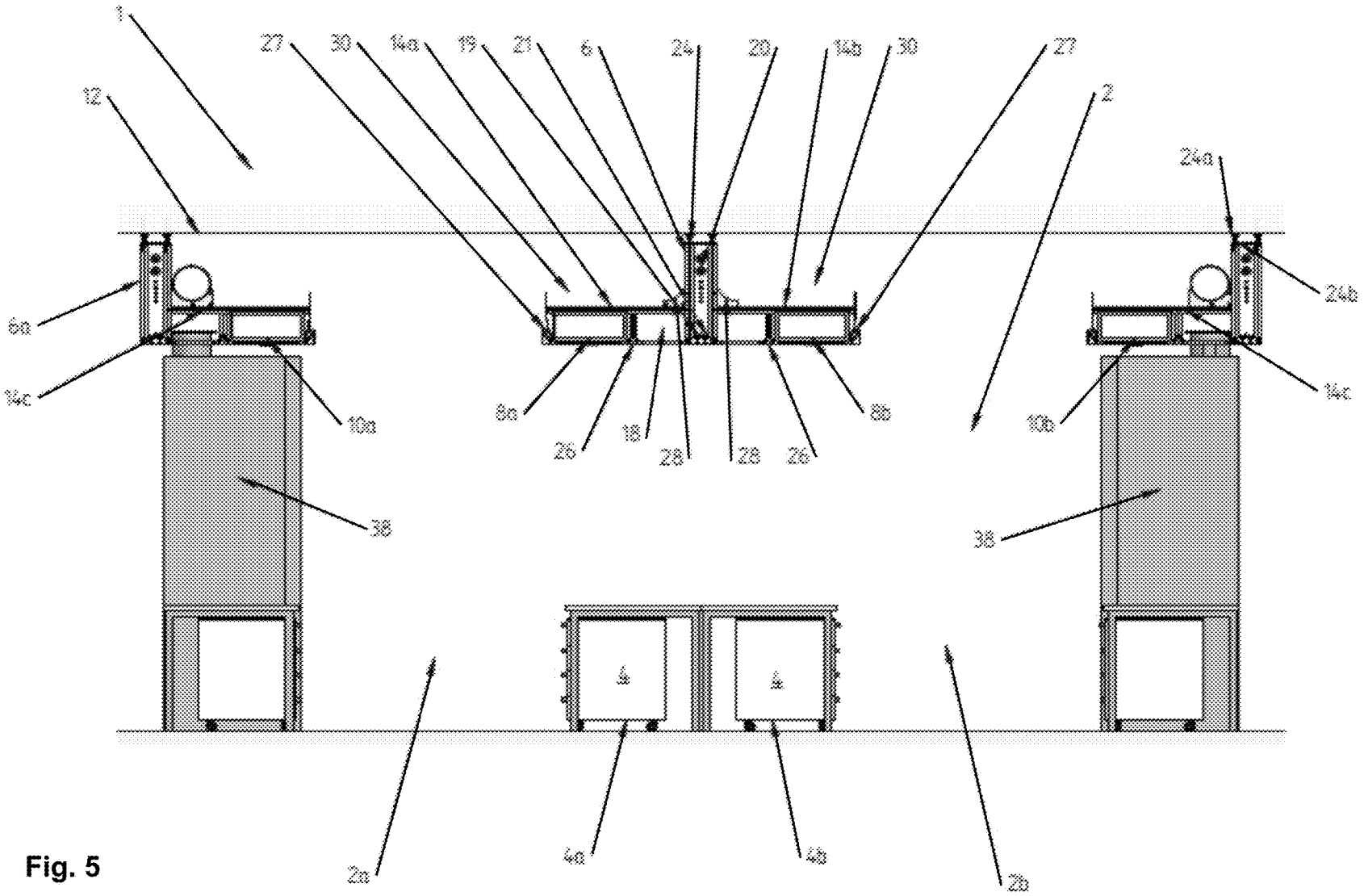
FIG. 5 shows a schematic cross-sectional view of a laboratory according to an alternative embodiment in which the exhaust air channels are not arranged on the extension arms of the central carrier elements, but rather on a side exhaust air channel received on the opposite side of the walking area on side carrier elements.
Figure 5A:
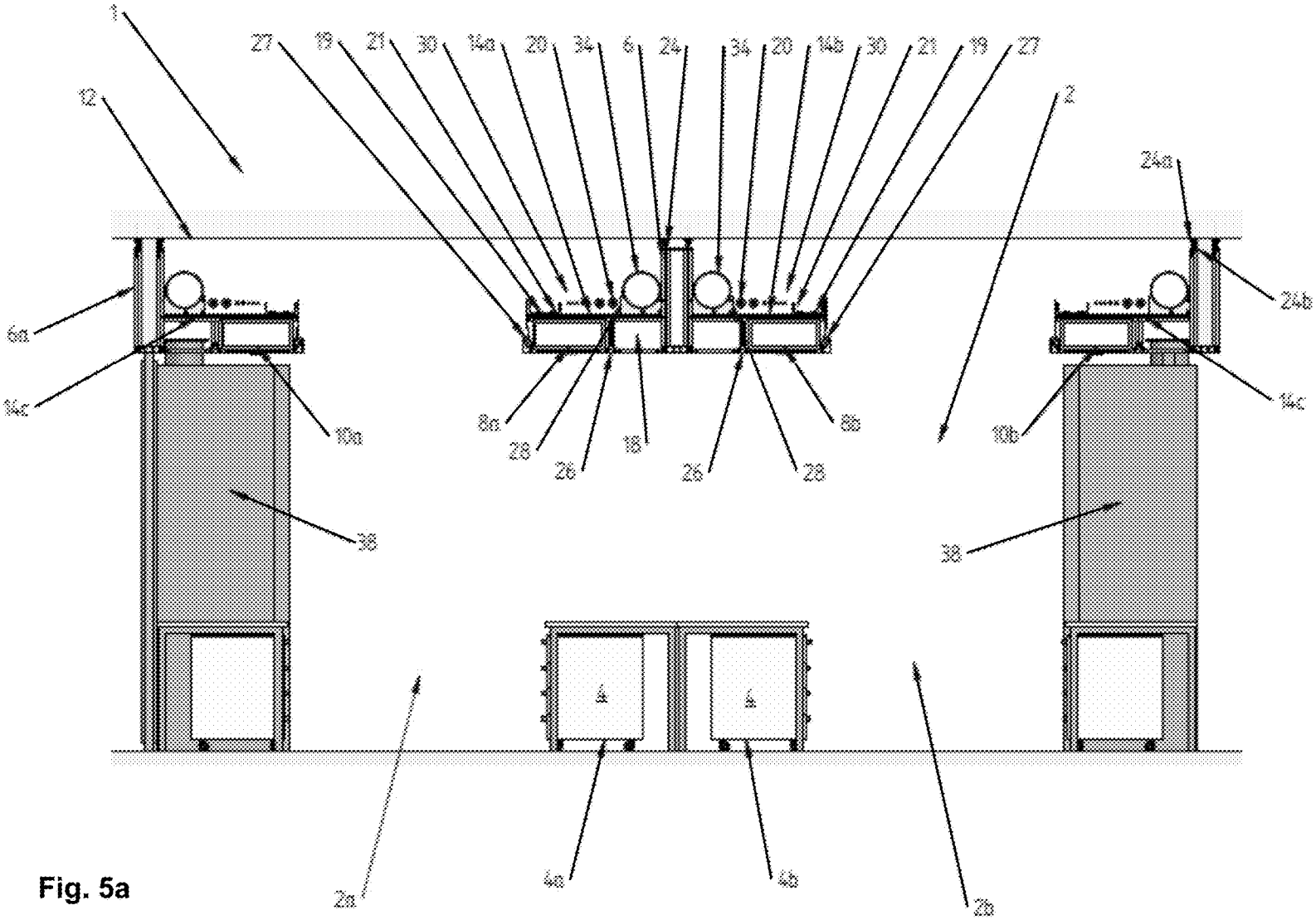
FIG. 5*a* shows the laboratory of FIG. 5 with supply lines.

According to another alternative embodiment of the disclosure the exhaust air channel 10, as is shown in the FIGS. 5 and 5*a*, is not received on one or both of the extension arms 14*a*, 14*b* of the center carrier elements 6 arranged above the laboratory tables 4, but rather a lateral or side exhaust air channel 10*a*, 10*b* is preferably carried by lateral or side carrier elements 6. These are arranged on the sides of the particular walking areas 2*a*, 2*b* on opposing sides of the laboratory table row 4, preferably via the outlets 38. Each of the side carrier elements comprise a vertical column element 6*a* and only a single side extension arm 14*c* attached to it, which arm extends in a horizontal plane in the direction of the particular adjacent walking area 2*a*, 2*b*.

As shown in FIGS. 5 and 5*a*, the lateral or side exhaust air conduit 10*a*, 10*b* is preferably fastened to the bottom of the side extension arm 14*c*. In addition, a corresponding process exhaust air line 34 may be arranged on top of the side extension arm and positioned above the vertical exhaust air tubes of the outlets 38. The exhaust air conduits 10*a*, 10*b* of this embodiment can be provided with slot-like suction removal openings that extend in the longitudinal direction of the exhaust air conduit 10*a*, 10*b*, and which are preferably interrupted in the area of the outlets 38. Alternatively, the lateral or side exhaust air conduits 10*a*, 10*b* can also comprise circular air inlet openings in this embodiment in which preferably no exhaust air conduit 10 is provided above the laboratory tables 4.

As further shown in FIG. 5*a*, supply lines for sanitary media (media used in the laboratory), electric lines or data transmission lines can be arranged on the top of the lateral exhaust air conduits 10*a*, 10*b*. These lines can be advantageously accessed from above in this embodiment. The pairwise, symmetrical arrangement of two air supply conduits 8*a*, 8*b* shown in FIGS. 5 and 5*a* in the area of the central longitudinal axis of the laboratory table row 4 and side exhaust conduit 10*a*, 10*b* above the outlets 38*a*, results in an efficient air flow. This arrangement supplies the persons working at the laboratory table row 4 with fresh air and ensures that hazardous vapors that may exit from the outlets 38 if the slides are unintentionally opened, are efficiently removed upward directly through the side exhaust air conduits 10*a*, 10*b* on the outer sides of the outlets 38, without the vapors passing into the walking area 2*a*, 2*b* or even into the area of the laboratory table row 4.

It should be understood that this description (including the figures) is only representative of some illustrative embodiments. For the convenience of the reader, the above description has focused on representative samples of all possible embodiments, and samples that teaches the principles of the invention. The description has not attempted to exhaustively enumerate all possible variations. That alternate embodiments may not have been presented for a specific portion of the invention, or that further undescribed alternate embodiments may be available for a portion, is not to be considered a disclaimer of those alternate embodiments. One of ordinary skill will appreciate that many of those undescribed embodiments incorporate the same principles of the invention as claimed and others are equivalent.

What is claimed is:

1. A laboratory ventilation arrangement, comprising a laboratory table row defining at least a first walking area and a second walking area on a first side and a second side of the laboratory table row, a plurality of center carrier elements configured to be in a spaced arrangement along the length of the table row and suspended above the laboratory table row;

wherein each center carrier element comprises a vertical column element having an upper end adapted to be fastened to a ceiling of a laboratory, and a lower end having horizontal extensions comprising a first extension arm extending toward a first side of the table row and a second extension arm extending toward the second side of the table row and over an area occupied by the laboratory table row, a first air supply conduit and a second air supply conduit having a plurality of air exit openings;

wherein the first air supply conduit is received on a bottom portion of the first extension arm and the second air supply conduit is received on a bottom portion of the second extension arm, the first and second air supply conduits being arranged along the first and second extension arms at a horizontal interval to define a lower receiving space between the first and second air supply conduits extending parallel to the first and second air supply conduits over a length of the laboratory table row and adapted to provide receiving space for supply lines;

an exhaust air conduit;

wherein the exhaust air conduit is a first side exhaust air conduit carried by a plurality of side carrier elements having a side vertical column element and a side extension arm fastened to the side vertical column element; and wherein the exhaust air conduit is arranged on the plurality of side carrier elements in a space separated from the first air supply conduit or the second air supply conduit.

2. The ventilation arrangement according to claim 1, wherein at least one of the first or the second air supply conduit is composed of an intrinsically stiff material.

3. The ventilation arrangement according to claim 2, wherein the intrinsically stiff material is sheet metal.

4. The ventilation arrangement according to claim 1, wherein the first air supply conduit is mechanically connected to a plurality of first extension arms to form a torsion-resistant unit.

5. The ventilation arrangement according to claim 4, wherein the second air supply conduit is mechanically connected to a plurality of second extension arms to form a torsion-resistant unit.

6. The ventilation arrangement according to claim 1, wherein the exhaust air conduit is mechanically connected to a plurality of side extension arms.

7. The ventilation arrangement according to claim 1, further comprising a longitudinal carrier connected to a lower end of the center carrier elements, and disposed parallel to the length of the laboratory table row.

8. The ventilation arrangement according to claim 7, wherein the longitudinal carrier has at least one longitudinal groove extending along a length of the carrier, wherein the groove is adapted to removably receive and adjustably position one or more of a wall element, shelf and media column.

9. The ventilation arrangement according to claim 1, wherein the upper end of the vertical column element further comprises a mechanical compensation arrangement adapted to adjustably couple the upper end of the vertical column element to a ceiling.

10. The ventilation arrangement according to claim 9, wherein the mechanical compensation arrangement comprises an upper plate and a lower plate having a spaced relationship and an inclination relationship with one another wherein the spaced and inclination relationship is adjustable by a screw element and wherein the upper plate is adapted to be fastened to a ceiling and the lower plate is fastened on the upper end of the vertical column element.

11. The ventilation arrangement according to claim 1, further comprising an illuminating element received underneath at least one of the first and the second extension arm.

12. The ventilation arrangement according to claim 1, wherein the vertical column element and at least one of the first and second extension arms are coupled by a reinforcement element.

13. The ventilation arrangement according to claim 1, further comprising an upper receiving space arranged in a plane above the lower receiving space and above at least one of the first and second extension arm.

14. The ventilation arrangement according to claim 1, further comprising a traction element having a lower end connected to a distal end of at least one of the first or second extension arm and an upper end adapted to be fastened to a ceiling.

15. The ventilation arrangement according to claim 1, wherein the first side exhaust air conduit is received on a bottom of the side extension arms.

16. The ventilation arrangement according to claim 15, wherein a laboratory process line including at least one of a sanitary line or a process air line are arranged on a top of the side extension arms and wherein the process line is disposed in a plane above the first side exhaust air conduit.

17. The ventilation arrangement according to claim 1, wherein the first air supply conduit and the first side air exhaust conduit are arranged pairwise at an interval from one another on opposing sides of the first walking area, and the second air supply conduit and a second side air exhaust conduit are arranged pairwise at an interval from one another on opposing sides of the second walking area.

* * * * *